US006247506B1

(12) United States Patent
Debaes et al.

(10) Patent No.: US 6,247,506 B1
(45) Date of Patent: Jun. 19, 2001

(54) METHOD FOR MANUFACTURING A FABRIC WITH RIB STRUCTURE, AND FABRICS MANUFACTURED ACCORDING TO THIS METHOD

(75) Inventors: Johnny Debaes, Moorslede; Ludo Smissaert, Assebroek; Nico Vandoorne, Rekkem, all of (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/435,783

(22) Filed: Nov. 8, 1999

(30) Foreign Application Priority Data

Nov. 6, 1998 (BE) ..... 09800809

(51) Int. Cl.[7] ..... D03D 27/06

(52) U.S. Cl. ..... 139/402; 139/403; 139/406; 139/408

(58) Field of Search ..... 139/394, 403, 139/405, 406, 408, 411, 402

(56) References Cited

U.S. PATENT DOCUMENTS 128,286 * 6/1872 Crompton .
939,230 * 11/1909 Dornan .
1,349,367 * 8/1920 Crossland .
1,932,981 10/1933 Milnes .
2,647,546 * 8/1953 Ryan ..... 139/403

FOREIGN PATENT DOCUMENTS 24871 9/1931 (NL) .

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

Method for manufacturing a fabric with a rib structure, in particular a false bouclé fabric, whereby a backing fabric is woven out of binding warp threads (7), (8) and weft threads (1), (2), whereby pattern warp threads (5), (6) are alternately interlaced in the backing fabric and along one side of the backing fabric are rib-formingly passed around at least one weft thread (3) running outside the backing fabric. A fabric is thus obtained with a rib structure on only one side. Because of this the consumption of pattern warp yarn can be reduced.

14 Claims, 1 Drawing Sheet

METHOD FOR MANUFACTURING A FABRIC WITH RIB STRUCTURE, AND FABRICS MANUFACTURED ACCORDING TO THIS METHOD

BACKGROUND OF THE INVENTION

This invention relates to a method for manufacturing a fabric with a rib structure, in particular a false bouclé fabric, whereby weft threads are brought in successive sheds between warp threads so that a fabric is formed with pattern warp threads which run alternately below and above one or several weft threads so that they form ribs.

This invention also relates to a fabric with a rib structure, in particular a false bouclé fabric, comprising weft threads and warp threads, of which pattern warp threads run alternately below and above one or several weft threads so that they form ribs.

A fabric with a rib structure which approximates the appearance of a loop pile fabric or bouclé fabric, is called a false bouclé fabric.

According to a known weaving method for manufacturing a false bouclé fabric, which has the above mentioned characteristics, tension warp threads are inwoven stretched in the fabrics and in each weft insertion cycle on the weaving machine two weft threads are simultaneously inserted one above the other. In successive insertion cycles the two weft threads are in relation to the tension warp threads alternately inserted along the upper side and along the lower side of the fabric.

In warp thread systems located next to each other a first and a second pattern warp thread of a different colour are provided in order to be able to make a design or a pattern visible with the two colours along the upper side of the fabric.

The first pattern warp thread is alternately rib-formingly passed over the two weft threads along the upper side of the fabric and interlaced between the two weft threads along the lower side of the fabric, in order to achieve a rib structure on the upper side of the fabric and to form the design or the pattern. The second pattern warp thread is interlaced opposite the first pattern warp thread, alternately between the two weft threads along the upper side of the fabric and passed around over the two weft threads along the lower side of the fabric. The colour of the second pattern warp thread is then not visible on the upper side, but it is on the lower side of the fabric. The second pattern warp thread forms a rib structure on the lower side of the fabric. With these known fabrics the weft threads are inwoven by the pattern warp threads. With each insertion cycle a rib line is produced (alternately along the upper side and along the lower side of the fabric).

Both the upper side and the lower side of this known fabric have a rib structure. On the lower side of the fabric a type of negative (with swapped colours) is obtained of the two-coloured design which is visible on the upper side of the fabric.

A disadvantage of this method is the high consumption of pattern warp yarn. The thus manufactured fabrics are relatively expensive because of this.

The purpose of this invention is to provide a method with which fabrics with a rib structure can be manufactured, with a lower pattern warp yarn consumption.

SUMMARY OF THE INVENTION

This purpose is achieved according to this invention by utilising a method with the characteristics mentioned in the first paragraph of this specification by proceeding so that a backing fabric is woven out of binding warp threads and weft threads, while the pattern warp threads are alternately interlaced in the backing fabric and are rib-formingly passed around at least one weft thread running outside the backing fabric.

In the preceding paragraph and in the first claim of this patent application corresponding thereto the expression "a weft thread running outside the backing fabric" is used in the sense of a weft thread which, at least in the location where the pattern warp thread is rib-formingly passed around this weft thread, runs outside the backing fabric. Other parts of such a weft thread can therefore be inwoven in the backing fabric.

Because of the fact that the pattern warp threads only have to form ribs on one fabric side (the rib side), the pattern warp yarn consumption is considerably reduced.

A fabric manufactured according to this method only has a rib structure on one side. This is not a disadvantage since for most applications of fabrics with a rib structure it is not required that the fabric has a rib structure on both sides.

According to this invention tension warp threads are preferably provided in the backing fabric, while the fabric is so woven that the weft threads running outside the backing fabric are part of a set of at least two weft threads running one above the other, while of each set of weft threads at least two weft threads run along the rib side of the fabric in relation to the tension warp threads.

Because of this a fabric with a very clear rib structure is obtained. The appearance of a fabric manufactured in that manner very closely approximates the appearance of a loop pile fabric.

In order to accentuate the rib structure even more, thicker threads can be taken for the weft threads running outside the backing fabric than for the weft threads inwoven in the backing fabric. By providing thinner weft threads in the backing fabric a more stable backing fabric is furthermore also obtained and the pattern warp yarn consumption is still further reduced.

The fabric is so woven according to a preferred method that, in the finished fabric, between two successive sets of weft threads a weft thread is provided inwoven in the backing fabric. This weft thread can then be utilised for interlacing the rib-forming pattern warp threads in the backing fabric.

It is moreover greatly preferred during successive weft insertion cycles of weft insertion means on a weaving machine to insert one weft thread and two weft threads respectively.

This method can for example be applied on a double rapier weaving machine, whereby the rapier device operating on the top insertion level alternately inserts a weft thread and inserts no weft thread during successive weft insertion cycles. In order to cancel the insertion of a weft thread either the presenting mechanism which is provided for presenting a weft thread to the top weft insertion mechanism can be disengaged, or the top weft insertion mechanism can be disengaged.

Preferably two binding warp threads and one tension warp thread are provided per reed tooth.

According to a very advantageous method the fabric is so woven that the weft threads running outside the backing fabric are part of a set of at least two weft threads running one above the other, and that a non-rib-forming pattern warp thread, running between weft threads of the aforesaid sets of weft threads running one above the other, is inwoven in the backing fabric. Because of this a very good rib effect is obtained.

The rib-forming pattern warp threads can also be interlaced under a weft thread inwoven along the back of the backing fabric. These pattern warp threads can because of this be well embedded in a synthetic material layer to be provided on the back of the fabric for that purpose. Preferably a latex layer is provided on the back of the fabric.

The non-rib-forming pattern warp threads can also be well embedded in a synthetic material layer on the back of the fabric if these pattern warp threads are inwoven in the backing fabric running alternately above a weft thread of the backing fabric and under a weft thread inwoven along the back of the backing fabric.

The pattern warp yarn consumption can be still further reduced if with the method according to this invention the rib-forming pattern warp threads are interlaced under a weft thread inwoven along the rib side of the backing fabric, and/or if non-rib-forming pattern warp threads are inwoven stretched in the backing fabric.

As appears from the foregoing the known fabrics with a rib structure have the disadvantage that they are relatively expensive, and this comes particularly because of the fact that their production requires a considerable amount of warp yarn.

This disadvantage is very effectively remedied according to this invention by providing a fabric with the characteristics mentioned in the second paragraph of this specification, in which binding warp threads and weft threads form a backing fabric, and in which pattern warp threads are alternately interlaced in the backing fabric and along one side of the backing fabric are rib-formingly passed around at least one weft thread running outside the backing fabric.

In the following specification a number of fabrics according to this invention, as well as the methods for manufacturing them, are described in greater detail. This specification only serves to explain further the characteristics of the method and the fabric according to this invention, and may therefore not be considered as a restriction on the protection claimed for this invention in the claims of this patent application.

In this specification reference is made, by means of reference numbers, to the figures attached hereto. Of these figures,

DETAILED DESCRIPTION

Figure 1:
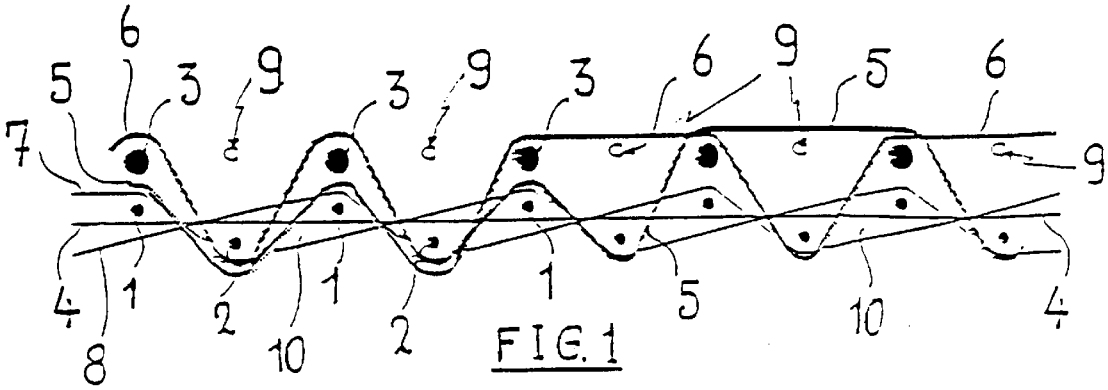
FIG. 1 is a schematic cross-section according to the warp direction of a false bouclé fabric, of which all pattern warp threads are woven through on the back of the fabric.

The fabrics of which a cross-section has been represented in the figures comprise weft threads (1), (2), (3), and a series of warp thread systems which respectively comprise one tension warp thread (4), two or more pattern warp threads (5), (6), and two binding warp threads (7), (8).

In the figures one warp thread system (4-8) and a number of weft threads (1), (2), (3) have been schematically represented. In each warp thread system the two binding warp threads (7), (8) cross each other repeatedly so that between these binding warp threads (7), (8) successive openings (10) are formed. Through each opening run two weft threads (1), (2), which respectively extend above and below the tension warp threads (4). The weft threads (1), (2) are because of this inwoven by the binding warp threads (7), (8), so that a backing fabric is formed. The tension warp threads (4) are incorporated stretched in this backing fabric.

Above one of the two weft threads (1), (2) of each opening runs a thicker weft thread (3) which extends outside the backing fabric. This means that in the fabric alternately a set of two weft threads (3), (1) running one above the other and one single weft thread (2) is provided. The single weft threads (2) between the successive sets of weft threads (1), (3) are inwoven in the backing fabric, while of the sets of weft threads running one above the other the thicker top weft thread (3) is not incorporated in the backing fabric and extends along the top of this backing fabric, and the bottom weft thread (1) is inwoven in the backing fabric.

The pattern warp threads (5), (6) are alternately interlaced in the backing fabric under the aforesaid single weft thread (2) and along the top of the backing fabric passed around the thicker weft thread (3) running outside the backing fabric. In this manner the parts of the pattern warp threads (5), (6) passed over the thicker weft threads (3) form a clear rib structure which closely approximates the appearance of a loop pile fabric.

Wider ribs are obtained by allowing the rib-forming pattern warp threads to float above several thicker weft threads (3) running outside the backing fabric. Because of this a type of relief structure is given to the fabric with an additional optical effect for the pattern design.

Figure 2:
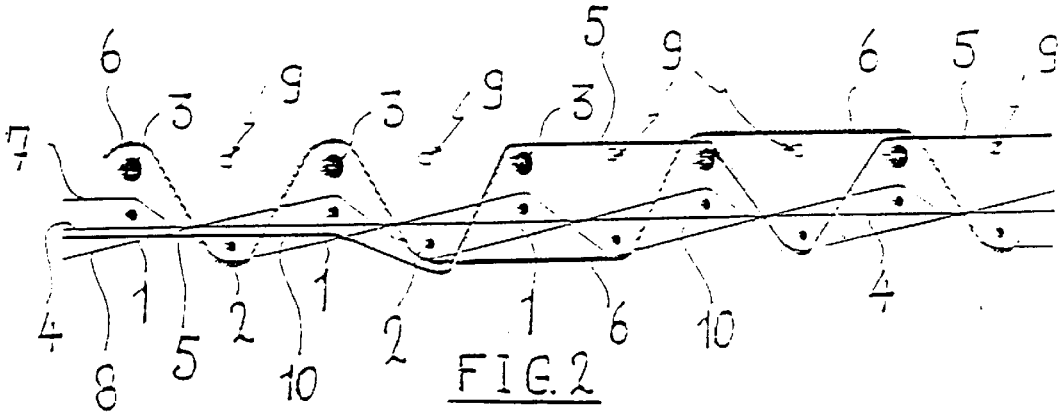
FIG. 2 is a schematic cross-section according to the warp direction of a false bouclé fabric, of which only the rib-forming pattern warp threads are woven through on the back of the fabric.

In the fabrics from FIGS. 1 and 2 the single weft threads (2) are in relation to the tension warp threads (4) inwoven along the back of the backing fabric, so that the rib-forming pattern warp threads (7), (8) are in each case woven through along the back of the backing fabric.

In the fabric from FIG. 1 the non-rib-forming parts of the pattern warp threads (5), (6), also called the dead pattern warp threads, run alternately between two weft threads (1), (3) running one above the other and under a single weft thread (2). These dead pattern warp threads are therefore also woven through on the back of the backing fabric. In this fabric all pattern warp threads are therefore woven through along the back of the fabric. This enables a good embedding of these pattern warp threads in a latex layer (not represented in the figures) which is provided on the back of the fabric. Because of the fact that dead pattern warp threads (5), (6) run between the weft threads running one above the other a greater rib height is obtained and therefore an even clearer rib structure.

In the fabric from FIG. 2 the non-rib-forming parts of the pattern warp threads (5), (6) are not woven through along the back of the fabric. These dead pattern warp threads (5), (6) married to the tension warp threads (4), are inwoven stretched in the backing fabric. A decrease in the pattern warp yarn consumption is therefore achieved.

Figure 3:
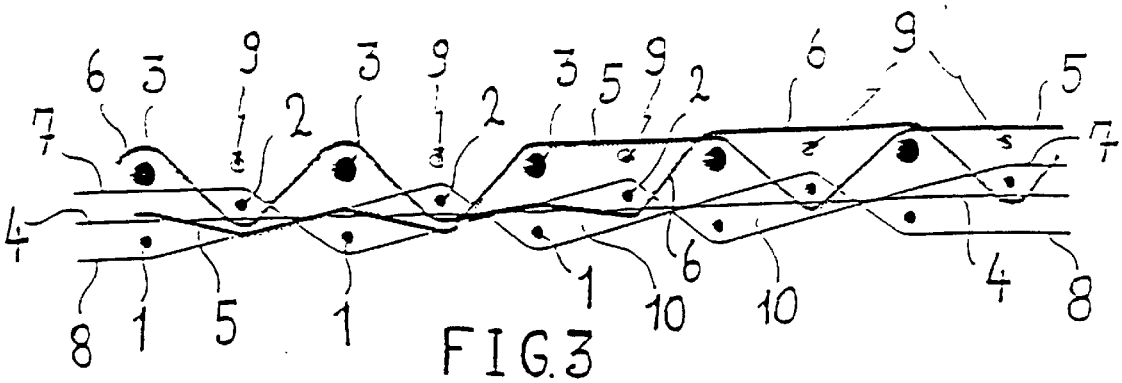
FIG. 3 is a schematic cross-section according to the warp direction of a false bouclé fabric, of which neither the rib-forming pattern warp threads nor the non-rib-forming (or dead) pattern warp threads are woven through on the back of the fabric.

In the fabric from FIG. 3 the bottom weft thread (1) of each set of weft threads running one above the other is in relation to the tension warp threads (4) inwoven along the back of the backing fabric, while the single weft thread (2) is inwoven along the top (the rib side) of the fabric. The rib-forming pattern warp threads (5), (6) which are interlaced around these single weft threads (2), are consequently not woven through along the back of the fabric. The non-rib-forming parts of the pattern warp threads (5), (6), just as in the fabric from FIG. 2, married to the tension warp thread (4) are inwoven in the backing fabric.

Because of the fact that in this fabric no pattern warp threads (7), (8) are woven through the consumption of pattern warp yarn is restricted to an absolute minimum.

The different pattern warp threads (5), (6) of a warp thread system have a different colour and are alternately rib-forming in accordance with the colours of a pattern to be formed. Because of the fact that dead pattern warp threads can be inwoven in the backing fabric more than two different pattern warp threads can be provided per warp thread system. Because of this the fabrics according to this invention can be woven with a greater colour variation than the existing fabrics with a rib structure.

The manufacturing of these fabrics preferably occurs on a weaving machine with two weft insertion means (e.g. rapiers), which are provided in order in successive weft insertion cycles to insert respective weft threads one above the other in a shed formed between the warp threads.

For weaving the above described fabrics in the successive weft insertion cycles alternately two weft threads (1), (3) one above the other and one single weft thread (2) are inserted. The single weft thread (2) is inserted by the bottom weft insertion means, while the top weft insertion means is disengaged or is not provided with a weft thread to be inserted during that working cycle. The places in the fabric where a weft thread is cancelled in that manner, are indicated in the figures by the reference number (9).

What is claimed is:

1. A fabric manufacturing method comprising bringing weft threads in successive sheds of a weaving machine between warp threads, forming a fabric with a rib structure by running pattern warp threads alternately below and above one or more weft threads, weaving a backing fabric with binding warp threads and the weft threads, interlacing the pattern warp threads alternately in the backing fabric and passing the pattern warp threads along one side of the backing fabric around at least one weft thread running outside the backing fabric for forming the rib structure.

2. The method of claim 1, wherein forming the fabric comprises forming a false boucle fabric.

3. The method of claim 1, further comprising providing tension warp threads in the backing fabric, weaving the fabric such that the weft threads running outside the backing fabric are part of a set of at least two weft threads running one above another, and running at least two weft threads of each set of weft threads along a rib side of the fabric corresponding to the tension warp threads.

4. The method of claim 3, wherein weaving the fabric comprises providing the weft threads running outside the backing fabric thicker than the weft threads inwoven in the backing fabric.

5. The method of claim 1, wherein weaving the fabric comprises finishing the fabric by inweaving a weft thread between two successive sets of weft threads in the backing fabric.

6. The method of claim 1, further comprising inserting respectively one weft thread and two weft threads during successive weft insertion cycles of a weft insertion device on the weaving machine.

7. The method of claim 1, further comprising providing two binding warp threads and one tension warp thread per reed tooth.

8. The method of claim 3, wherein weaving the fabric comprises weaving such that the weft threads running outside the backing fabric are part of a set of at least two weft threads running one above another, and inweaving in the backing fabric a non-rib-forming pattern warp thread running between the weft threads of the two sets of weft threads running one above another.

9. The method of claim 3, further comprising interlacing rib-forming pattern warp threads under a weft thread inwoven along the rib side of the backing fabric.

10. The method of claim 3, further comprising inweaving non-rib-forming pattern warp threads in the backing fabric running alternately above a weft thread of the backing fabric and under a weft thread inwoven along the back of the backing fabric.

11. The method of claim 9, further comprising interlacing the rib-forming pattern warp threads under a weft thread inwoven along the rib side of the backing fabric.

12. The method of claim 3, further comprising inweaving a non-rib-forming pattern warp thread stretched in the backing fabric.

13. A fabric with a rib structure comprising pattern warp threads running alternately below and above one or more of the weft threads, ribs formed by the pattern warp threads, binding warp threads and the weft threads forming a backing fabric, the pattern warp threads being alternately interlaced in the backing fabric and the ribs formed by the pattern warp threads running along one side of the backing fabric and passing around at least once weft thread running outside the backing fabric.

14. The fabric of claim 13, wherein the fabric is a false boucle fabric.

* * * * *